US007497759B1

(12) United States Patent
Davis

(10) Patent No.: US 7,497,759 B1
(45) Date of Patent: Mar. 3, 2009

(54) DIRECTIONALLY CONTROLLABLE, SELF-STABILIZING, ROTATING FLYING VEHICLE

(76) Inventor: Steven Davis, 332 Mt. Wooland Rd., Eastsound, WA (US) 98245

( * ) Notice: Subject to any disclaimer, the term of this patent is extended or adjusted under 35 U.S.C. 154(b) by 289 days.

(21) Appl. No.: 11/424,433

(22) Filed: Jun. 15, 2006

Related U.S. Application Data

(63) Continuation-in-part of application No. 11/106,146, filed on Apr. 14, 2005, now Pat. No. 7,255,623, which is a continuation of application No. 10/924,357, filed on Aug. 24, 2004, now Pat. No. 6,899,586, which is a continuation of application No. 10/647,930, filed on Aug. 26, 2003, now Pat. No. 6,843,699, which is a continuation-in-part of application No. 09/819,189, filed on Mar. 28, 2001, now Pat. No. 6,688,936.

(60) Provisional application No. 60/453,283, filed on Mar. 11, 2003.

(51) Int. Cl.
*A63H 30/00* (2006.01)
*B64C 29/00* (2006.01)

(52) U.S. Cl. ..... 446/454; 446/46; 446/48; 244/23 C

(58) Field of Classification Search ..... 446/454, 446/456, 34, 46, 48, 36–35; 244/12.2, 12.3, 244/23 A, 23 B, 23 C, 23 R; 60/904
See application file for complete search history.

(56) References Cited

U.S. PATENT DOCUMENTS 5,297,759 A * 3/1994 Tilbor et al. ..... 244/17.11
2002/0104921 A1* 8/2002 Louvel ..... 244/12.1

* cited by examiner

*Primary Examiner*—Dmitry Suhol
*Assistant Examiner*—Alex F. R. P. Rada, II

(57) ABSTRACT

A rotating flying vehicle in accordance to an embodiment of the present invention includes a hub having an outer perimeter, an outer ring having a diameter greater than the outer perimeter, a plurality of blades extending outwardly and downwardly connecting the hub to the outer ring, and a plurality of rotor assemblies. Each rotor assembly further includes a motor to spin a propeller, where the propellers are positioned beneath the plurality of blades. The propellers when spinning will cause the hub, blades, and outer ring to sufficiently rotate and generate lift such that the vehicle will fly. The vehicle also includes a system for determining a directional point of reference for the rotor assemblies when the vehicle is rotating and includes a control system to fly the vehicle in a specified direction relative to a remote controller.

27 Claims, 15 Drawing Sheets

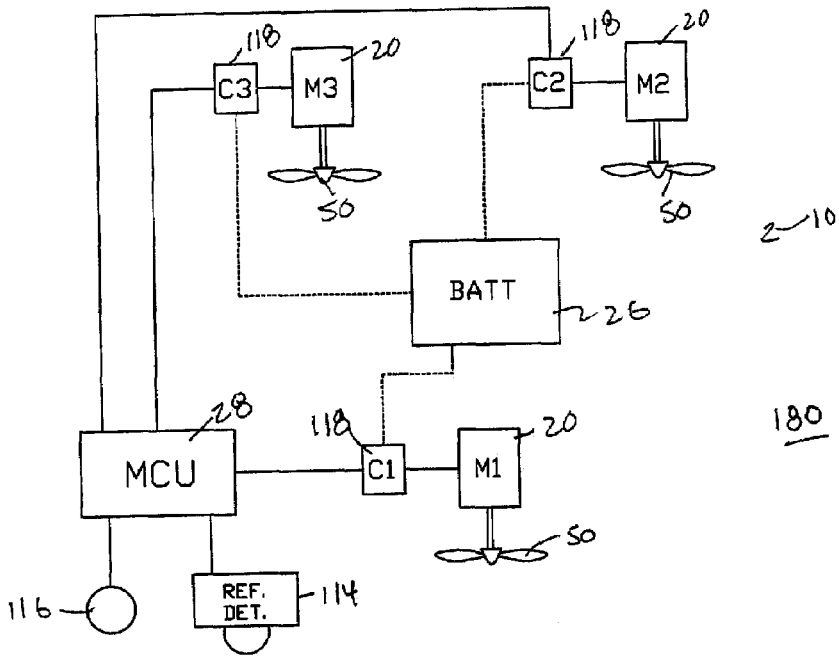
Figure 10a
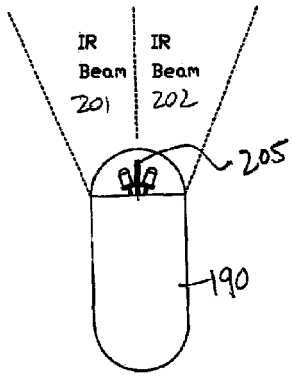
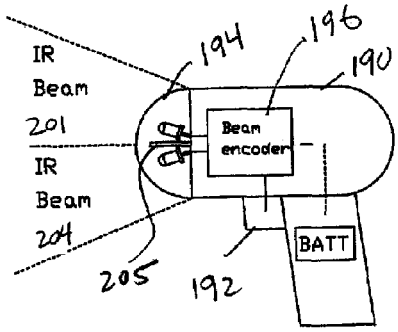

DIRECTIONALLY CONTROLLABLE, SELF-STABILIZING, ROTATING FLYING VEHICLE

CROSS REFERENCE TO RELATED APPLICATIONS

This application is a Continuation In Part of Ser. No. 11/106,146 filed Apr. 14, 2005, which is a continuation of U.S. Pat. No. 6,899,586, which is a continuation of U.S. Pat. No. 6,843,699. U.S. Pat. No. 6,843,699 claims the benefit of U.S. Provisional Application 60/453,283 filed on Mar. 11, 2003 and is a Continuation In Part Application of U.S. Pat. No. 6,688,936. All of which are incorporated by reference.

FIELD OF THE INVENTION

This invention relates to flying vehicles that are directionally controllable self-stabilizing rotating vehicles.

BACKGROUND OF THE INVENTION

Most vertical takeoff and landing vehicles rely on gyro stabilization systems to remain stable in hovering flight. For instance, the inventor's previous U.S. Pat. No. 5,971,320 and corresponding International PCT Application WO 99/10235 disclose a helicopter with a gyroscopic rotor assembly to control the orientation or yaw of the helicopter. However, different characteristics are present when the entire body of the vehicle, such as a flying saucer, rotates. Gyro stabilization systems are typically no longer useful when the entire body rotates, for example, see U.S. Pat. Nos. 5,297,759; 5,634,839; 5,672,086; and U.S. Pat. Nos. 6,843,699 and 6,899,586.

However, a great deal of effort is still made in the prior art to eliminate or counteract the torque created by horizontal rotating propellers in flying aircraft in an effort to increase stability. For example, Japanese Patent Application Number 63-026355 to Keyence Corp. provides a first pair of horizontal propellers reversely rotating from a second pair of horizontal propellers in order to eliminate torque. See also U.S. Pat. No. 5,071,383 which incorporates two horizontal propellers rotating in opposite directions to eliminate rotation of the aircraft. Similarly, U.S. Pat. No. 3,568,358 discloses means for providing a counter-torque to the torque produced by a propeller because, as stated in the '358 patent, torque creates instability as well as reducing the propeller speed and effective efficiency of the propeller.

The prior art also includes flying or rotary aircraft which have disclosed the ability to stabilize the aircraft without the need for counter-rotating propellers. U.S. Pat. No. 5,297,759 incorporates a plurality of blades positioned around a hub and its central axis and fixed in pitch. A pair of rotors pitched transversely to a central axis to provide lift and rotation are mounted on diametrically opposing blades. Each blade includes turned outer tips, which create a passive stability by generating transverse lift forces to counteract imbalance of vertical lift forces generated by the blades. This helps to maintain the center of lift on the central axis of the rotors. In addition, because the rotors are pitched transversely to the central axis to provide lift and rotation, the lift generated by the blades is always greater than the lift generated by the rotors.

Nevertheless, there is always a continual need to provide new and novel self-stabilizing rotating vehicles that do not rely on additional rotors to counter the torque of a main rotor. Such self-stabilizing rotating vehicles should be inexpensive and relatively noncomplex.

In addition to providing a self-stabilizing rotating vehicle, the ability to provide a simple hovering vehicle that is also controllable greatly enhances the vehicle. When the entire vehicle rotates the vehicle loses an orientation reference, which helps the remote user determine the direction in which the vehicle should move. In helicopters, airplanes, or other typical flying aircraft that have defined front ends or noses, the aircraft has a specific orientation that is predetermined by the nose of the vehicle. In such circumstances a user controlling the aircraft could push a joystick controller forwards (or push a forwards button) to direct the aircraft to travel forwards from its point of reference, similar directional controls are found in conventional remote controlled vehicles. However, when a vehicle completely rotates, such as a flying saucer or any other rotating vehicle, the rotating vehicle loses its orientation as soon as it begins to spin, making directional control difficult to implement. For example, U.S. Pat. No. 5,429,542 to Britt, Jr. as well as U.S. Pat. No. 5,297,759 to Tilbor et al. disclose rotating vehicles but only address movement in an upwards, downwards, and spinning direction; and U.S. Pat. Nos. 5,634,839 and 5,672,086 to Dixon discuss the use of a control signal to direct the rotating vehicle towards or away from the user, thus requiring the user to move about the rotating vehicle to the left or right if the user wants the rotating vehicle to move towards that particular direction.

SUMMARY OF THE INVENTION

In accordance with an embodiment a self-stabilizing controllable rotating flying vehicle is provided. The rotating vehicle includes a hub with a plurality of blades fixed thereto. The blades further extend outwardly and downwardly to connect to an outer ring. At least two rotor assemblies are provided and each includes a propeller positioned beneath the blades. As the propellers (defined by the rotor assemblies) spin, the hub, blades, and outer ring rotate in an opposite direction caused by the torque of the spinning propellers. The propellers are further controllable by a remote control in a manner that moves the rotating vehicle in various directions, such as up and down, left and right, and forward and backwards.

In a first control system used to move the flying rotating vehicle in various directions, the rotating vehicle includes a non directional receiver and a reference detector receiver for receiving a point of reference signal, both receivers are in communication with a microprocessor. A hand held controller includes a transmitter that emits encoded commands to move the flying rotating vehicle in a specified direction relative to the user. The encoded commands are received by the non directional receiver. In addition, the microprocessor has programming to control the rotor assemblies in response to the received encoded commands and in relation to the directional point of reference such that the flying rotating vehicle moves in the specified direction relative to the remote user. The first control system includes programming to generate a drive signal for each rotor assembly, wherein the drive signals control the rotating vehicle to fly in the specified direction.

The hand held controller may include a throttle controller that is manually operable by the user. The throttle controller when manipulated by the user causes the transmitter to send encoded commands to indicate to the microprocessor to increase and decrease the level of the drive signals to each rotor assembly. This would cause the rotating vehicle to move up or down. The hand held controller may also include a directional controller that is manually operable by the user. The directional controller when manipulated by the user causes the transmitter to send encoded commands to indicate to the microprocessor to generate the drive signals for each rotor assembly. The drive signals would include a sinusoidal wave that is out of phase with one another by a predetermined offset angle defined by the placement of the rotor assemblies in reference to each other and includes amplitude defined to control the speed in which directional controls are made.

In a second control system, the rotating vehicle includes a radio receiver and means to control the rotor assemblies in response to drive signals received by the radio receiver. A hand held controller has a radio transmitter in communication with a microprocessor. The microprocessor has programming to generate the drive signals in response to inputs from the hand held controller and the directional reference received from the rotating vehicle, such that inputs relate to moving the flying rotating vehicle in a specified direction relative to the hand held controller and the drive signals control the rotating vehicle to move in the specified direction. The drive signals are transmitted from the radio transmitter. Thus the rotor assemblies are controlled to move the flying rotating vehicle in the specified direction relative to the hand held controller when the radio receiver receives the drive signals.

The hand held controller may further include a throttle controller manually operable by the user. The throttle controller when manipulated by the user causes the microprocessor to increase and decrease levels of the drive signals. In addition, the hand held controller may include a directional controller manually operable by the user. The directional controller when manipulated by the user causes the microprocessor to generate drive signals which include sinusoidal waves that are out of phase with one another by the predetermined offset angle and include amplitudes of the waves to control the speed in which the directional movements are made.

In a third control system, a hand held controller is operable by a user. The controller includes four transmitters in a circular quadrant placement. Each transmitter sends a signal that is identifiable from the other signals. The hand held controller also includes a signal blocking element positioned between two adjacent transmitters to reduce intermingling of signals. The rotating vehicle has a receiver, and a microprocessor in communication with the receiver. The microprocessor has the ability to generate drive signals in relation to the received signals and to send the drive signals to the rotor assemblies. The drive signals control the rotating vehicle to fly in a specified direction.

The hand held controller may further include a throttle input manually operable by the user. The controller also includes means to augment each signal emitted from the hand held controller in response to the throttle input. The microprocessor positioned in the rotating vehicle has programming to control levels of the drive signals in relation to the augmentation of the signals.

In a fourth control system, which is similar to the third control system, the hand held controller includes a radio transmitter. The throttle input positioned in the hand held controller is used to generate a signal in response thereto. The signal is sent from the radio transmitter to the rotating vehicle that includes a radio receiver. The radio receiver is in communication with the microprocessor, which has programming to control levels of the drive signals in relation received radio signal.

In a fifth control system the rotating vehicle includes a transmitter for sending a reference signal, and includes a receiver for receiving drive signals. The drive signals are used to control the rotor assemblies to move the rotating vehicle in a specified direction. A hand held controller operable by a user is also provided. The hand held controller includes two adjacent receivers, a signal blocking element positioned between the two adjacent receivers to reduce intermingling of the reception of the reference signal. A microprocessor is in communication with the receivers and has a means to generate the drive signals in relation to the received reference signal. A transmitter in communication with the microprocessor is used to send the drive signals to the rotating vehicle. When the hand held controller is moved in a direction and the reception of the reference signal by the two adjacent receivers changes, the microprocessor generates drive signals to move the rotating vehicle in a specified direction that corresponds to the movement of the hand held controller.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein:

FIG. 10*a* is a third control system used to directionally control the rotating vehicle;

DETAILED DESCRIPTION OF THE EMBODIMENTS

Figure 1:
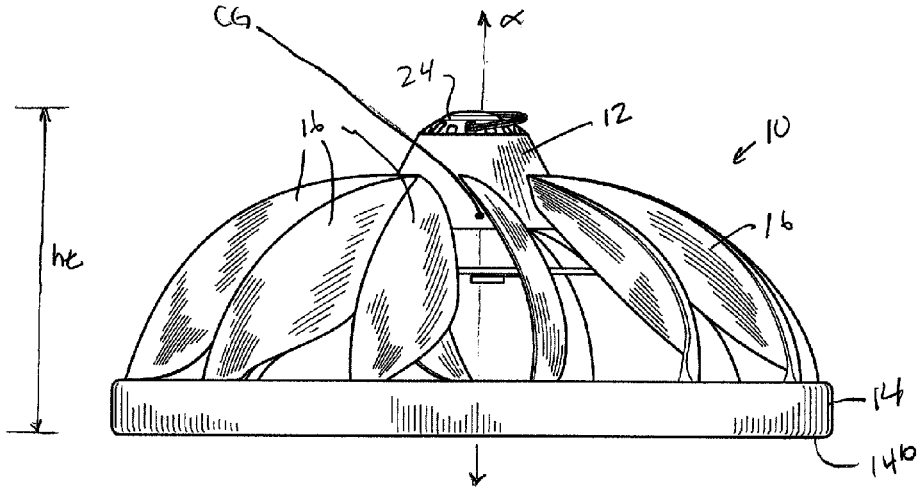
FIG. 1 is a side view of a directionally controllable self-stabilizing rotating vehicle in accordance with a first embodiment.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
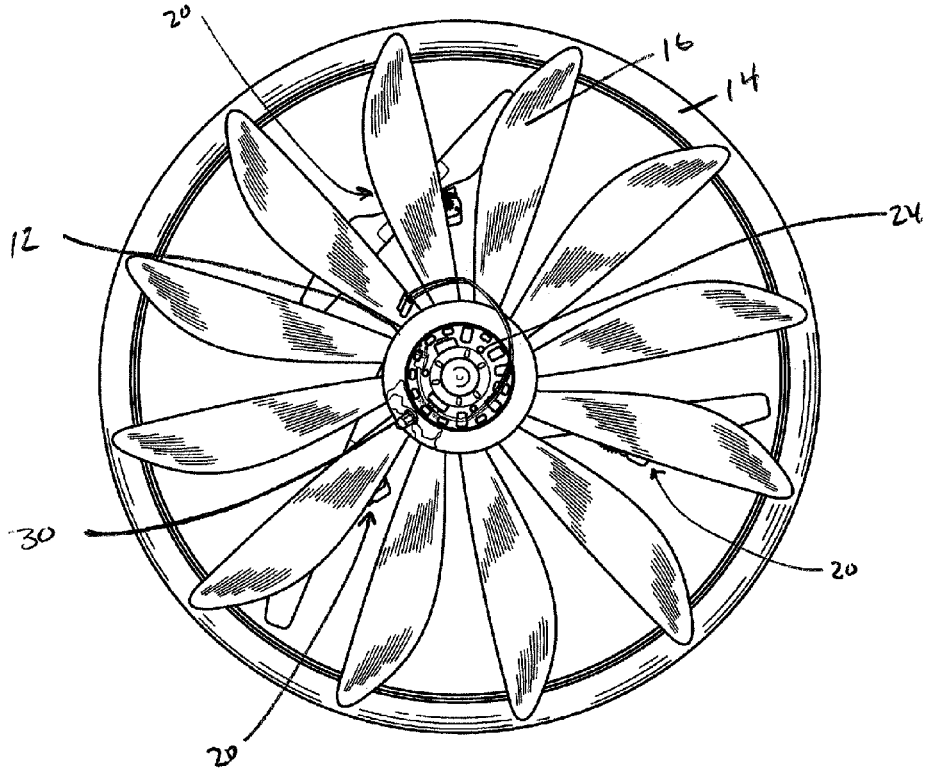
FIG. 2 is a top view of the vehicle from FIG. 1.
Figure 3:
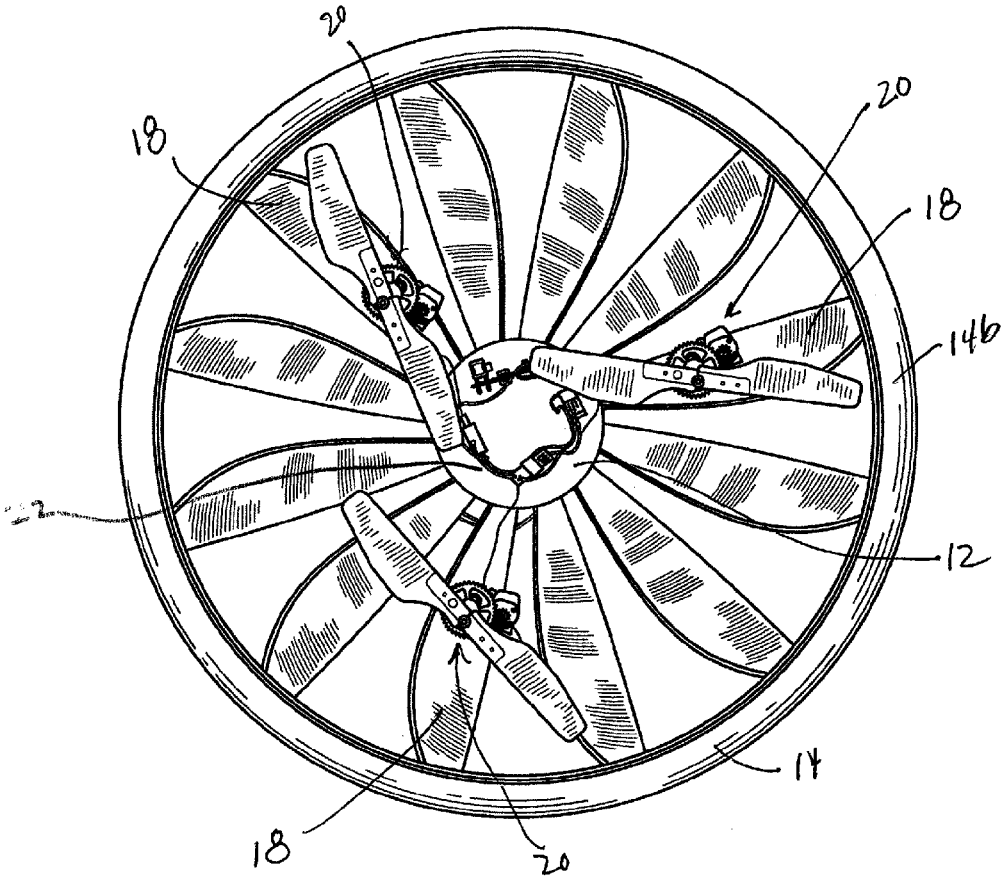
FIG. 3 is a bottom view of the vehicle from FIG. 1.
Figure 4:
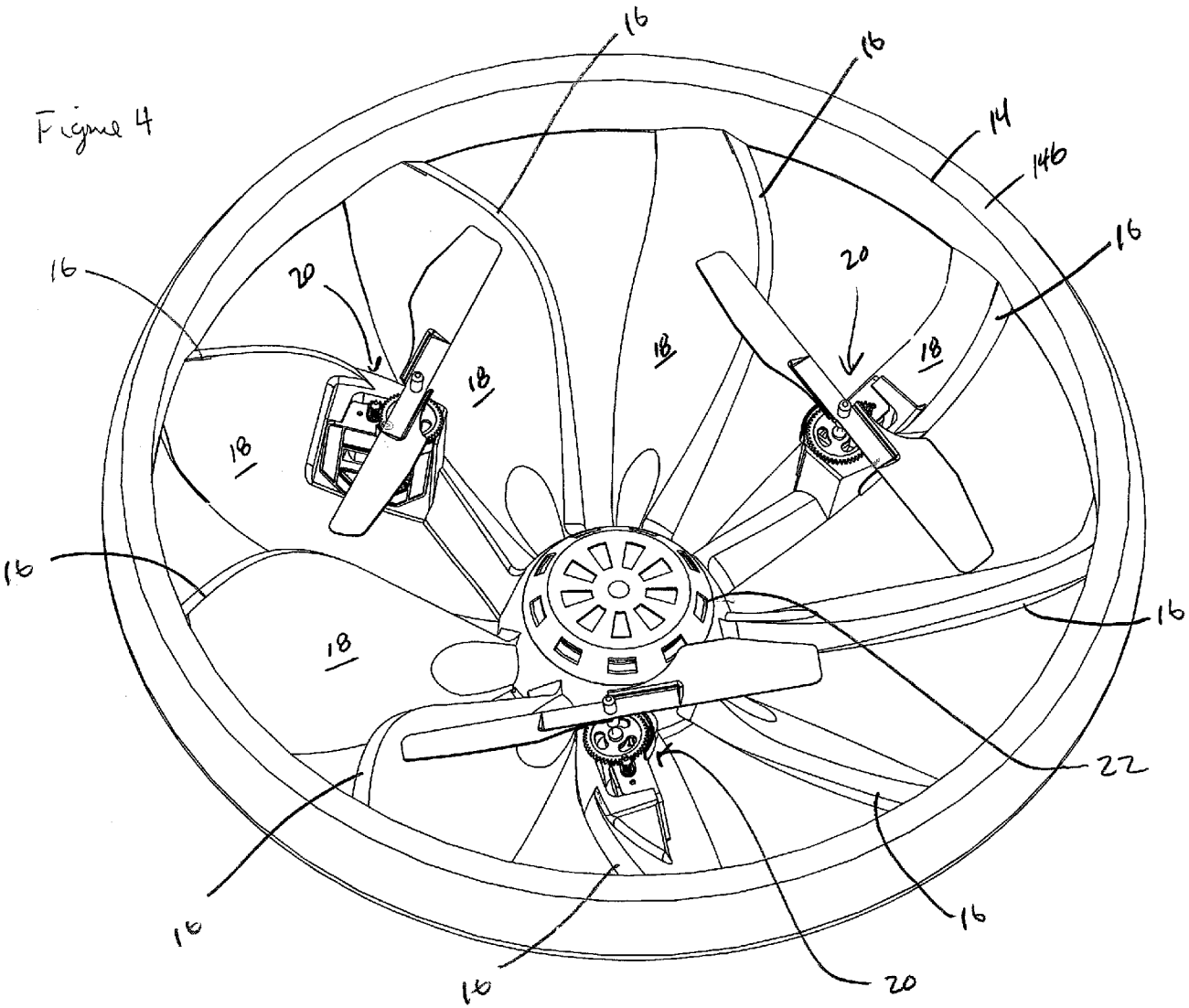
FIG. 4 is a bottom perspective view of a directionally controllable self-stabilizing rotating vehicle in accordance with another embodiment.

Referring to FIGS. 1 through 3, in a first embodiment of the present invention a flying rotating vehicle 10 is provided. The vehicle 10 includes a hub 12 and an outer ring 14. A plurality of blades 16 extend outwardly and downwardly from the hub 12 to the outer ring 14. Separately secured to the underside 18 of three of the blades 16 are rotor assemblies 20. FIG. 4 illustrates another vehicle 10 that has fewer blades 16, further illustrating that the number of blades would not affect that scope of the invention. The placement of and manner of securing the rotor assemblies 20 to the flying rotating vehicle 10 may also change. For example, the rotor assemblies 20 may be secured to the flying rotating vehicle 10 by any means for securing. Such means may include the method described hereinabove, or may include securing each rotor assembly 20 to one or more rods (not shown) that are positioned below the blades and allow the rotor assemblies to be secured to the flying rotating vehicle 10 at a position below the blades. Alternative means may include the ability to secure or suspend the rotor assemblies, on rods or the like, between the blades and angled downwardly such that the propeller 50 (defined from the rotor assembly 20) are beneath or between the blades. In any of these attachment configurations, the propellers 50 may interact with the blades 16 to aid in self stabilization and to increase efficiency of the propellers 50.

Figure 5:
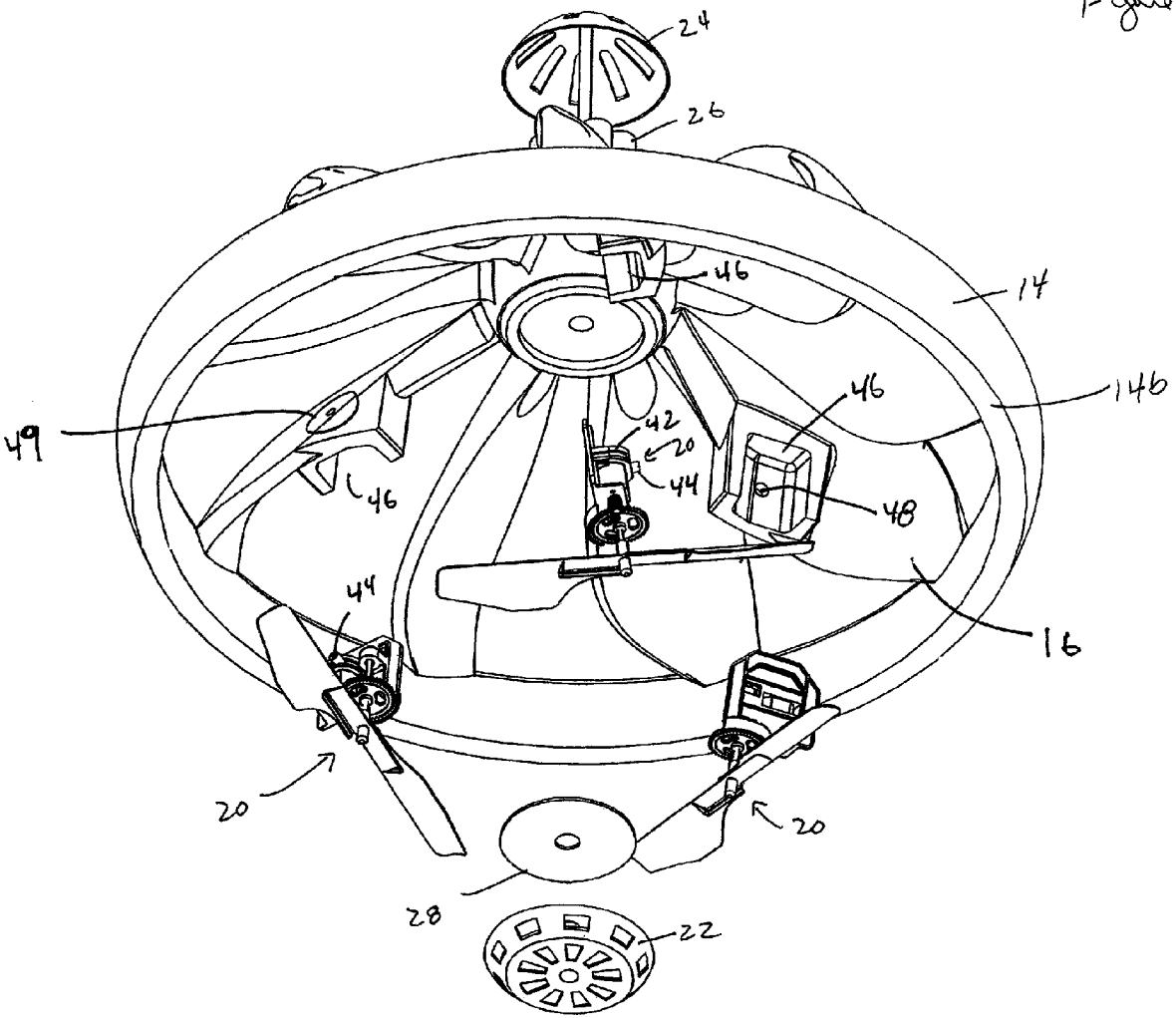
FIG. 5 is an exploded bottom perspective view of FIG. 4.

Referring also to FIG. 5, the hub 12 includes a lower cap 22 and an upper cap 24 that are secured to each other through the hub capturing various components there between. The components housed against or within the hub 12 may include a power supply 26 and a microprocessor 28.

Figure 6:
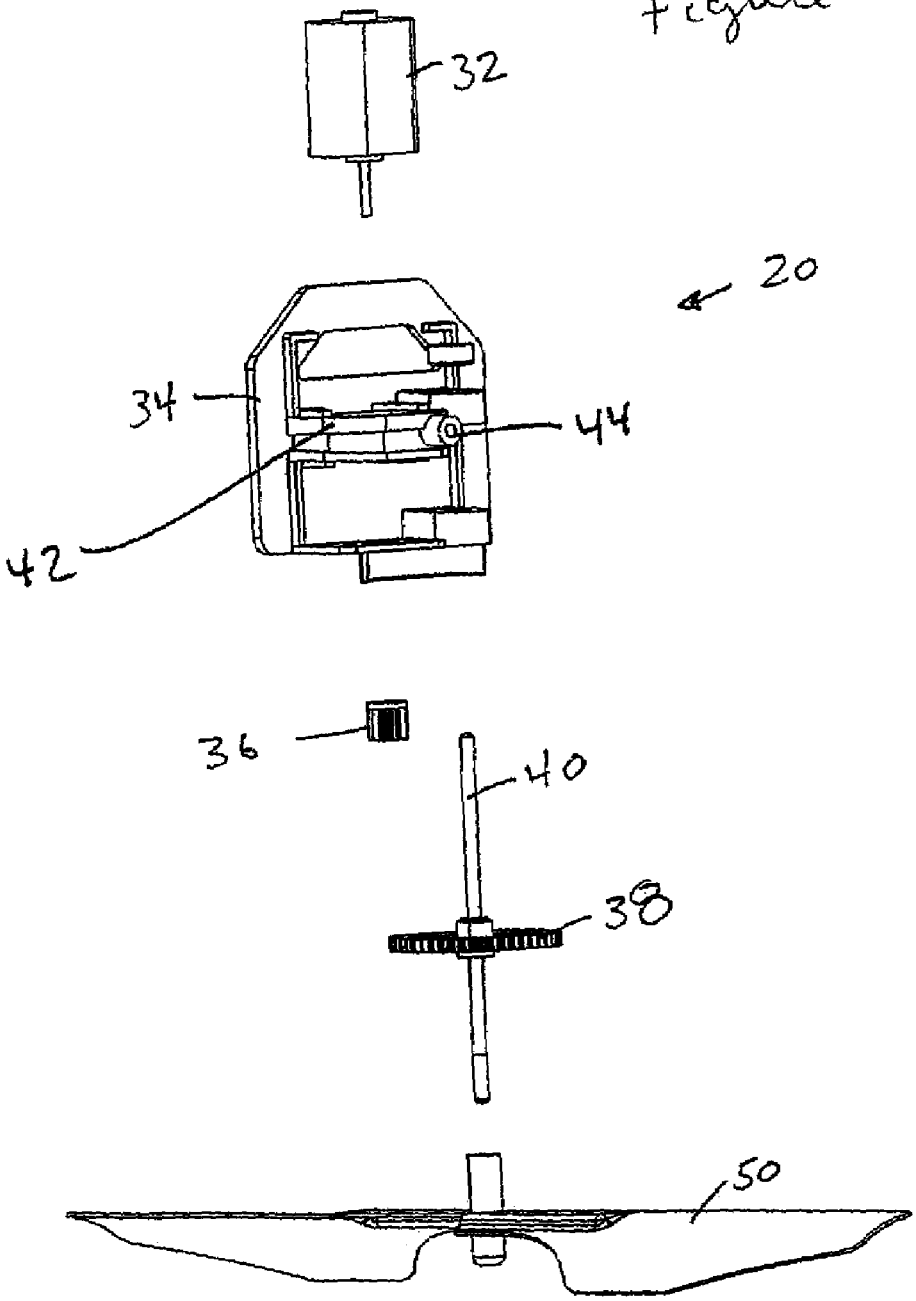
FIG. 6 is a exploded view of the rotor assembly.

Referring now to FIG. 6, each rotor assembly 20 would include a motor 32 operatively connected to drive a rotor or propeller 50. The motor 32 is secured to a gear box 34. The motor 32 drives a pinion 36, which rotates a propeller gear 38 mounted on a propeller shaft 40. The propeller 50 is secured to an end of the propeller shaft 40. As such when the rotor assembly is activated, the motor 32 rotates the propeller 50.

Continuing to refer to FIGS. 5 and 6, the gear box 34 includes a wedge shaped face 42 with a mounting pin 44 extending outwardly therefrom. The wedge shaped face 42 fits into an accommodating opening 46 on the underside 18 of a blade 16. The opening 46 on the blade 16 also includes an aperture 48 to accommodate the pin 44. A lock, screw or other type fastener 49 may be used with the pin 44 to secure the rotor assembly 20 to the blade 16.

As the propellers 50 rotate, no attempt is made to counter the torque created from the rotating propeller 50. Instead the torque causes the rotating vehicle 10 to rotate in the opposite direction. With sufficient RPMs the rotating vehicle 10 will lift off of the ground or a surface and begin flying. Once the rotating vehicle 10 is flying, the outer ring 14 protects the blades 16 and propellers 50. As mentioned above, the outer ring 14 and hub 12 are connected by the plurality of blades 16. The blades 16 have lifting surfaces positioned to generate lift as the vehicle 10 rotates. Even though the blades 16 are rotating in the opposite direction as the propellers 50, both are providing lift to the rotating vehicle 10. The blades 16 are categorized as counter-rotating lifting surfaces. The induced drag characteristics of the propellers 50 verses the blades 16 can also be adjusted to provide the desired body rotation speed. In addition, the propellers 50 may be inclined at an angle to add torque to the rotating vehicle 10 to achieve a more desirable rotational speed, which may help the self stabilization effect of the rotating vehicle 10. The propellers 50 may be inclined at about 0-10 degrees, more preferably at about 4-5 degrees.

The rotating vehicle 10 has the ability to self stabilize during rotation. This self stabilization is categorized by the following: as the rotating vehicle 10 is moved in someway it tilts to one direction and starts moving in that direction. A blade, of the plurality of blades 16, that is on the preceding side of the rotating vehicle 10 will get more lift than the blade on the receding side. This happens because the preceding blade will exhibit a higher inflow of air than the receding blade. Depending on the direction of rotation, the lift is going to be on one side or the other. This action provides a lifting force that is 90 degrees to the direction of travel. Due to gyroscopic procession a reaction force manifests 90 degrees out of phase with the lifting force. This reaction force opposes movement of the vehicle and thus the rotating vehicle 10 tends to self stabilize. The self-stabilizing effect is thus caused by the gyroscopic procession and the extra lifting force on the preceding blade.

The placement of the center of gravity (CG, FIG. 1) may also be a contributing factor for self-stabilization. It is believed that the self-stabilizing effect will increase when the CG is positioned above the bottom 14*b* of the outer ring 14 by a predetermined distance. The predetermined distance above the bottom 14*b* of the outer ring 14 was further found to be a distance substantially equal to about 10% to 50% of the internal diameter of the outer ring, more preferably to about 20% to 30% of the internal diameter of the outer ring. In addition, since overall weight contributes to the CG position, the CG position is easier to control when the blades 16 and outer ring 14 are made from a light weight material.

The rotating vehicle 10 may also be particularly stable because there is a large amount of aerodynamic dampening caused by the large cross-sectional area of the blades 16. Stability is also believed to be enhanced by having a higher rotational moment of inertia due to the weight of the multiple motor mechanisms mounted away from the central axis of the hub.

During operation, the propellers 50 are spinning thus drawing air from above the rotating vehicle downwardly through the counter rotating blades 16 within the outer ring 14. The air is thus being conditioned by the blades before hitting the propellers 50. By conditioning the air it is meant that the air coming off the blades 16 is at an angle and at an acceleration, as opposed to placing the propellers 50 in stationary air and having to accelerate the air from zero or near zero. The efficiency of the propellers 50 will be increased as long as the propellers 50 are specifically pitched to take the accelerated air into account.

In order to directionally control the rotating vehicle 10, meaning to control the flying rotating vehicle in up/down, forward/backward, and left/right directions, a control system is employed. The control system needs to provide a position reference to coordinate directional commands relative to the operator. The position reference can be achieved by using a directionally transmittable or receivable medium such as radio, ultrasound, or light. In addition an external reference that both the rotating vehicle and a hand held controller have access to, such as earths magnetic field, sun or man made signals from a beacon or GPS signals, could be used to provide a relative directional reference.

The control system also needs to translate control commands to the appropriate rotor assembly. This may be performed either in the hand held controller or in the rotating vehicle. In either case a means of conveying the needed information between the hand held controller and the rotating vehicle is necessary. This can be done by a separate transmission medium or encoded within the reference medium or some combination of both. Some of the following control system embodiments use infrared light as a directional medium. This is only because IR emitters and receivers are readily available and inexpensive. And their extensive use for remote controllers in the consumer electronic industry made the selection easier.

Figure 7:
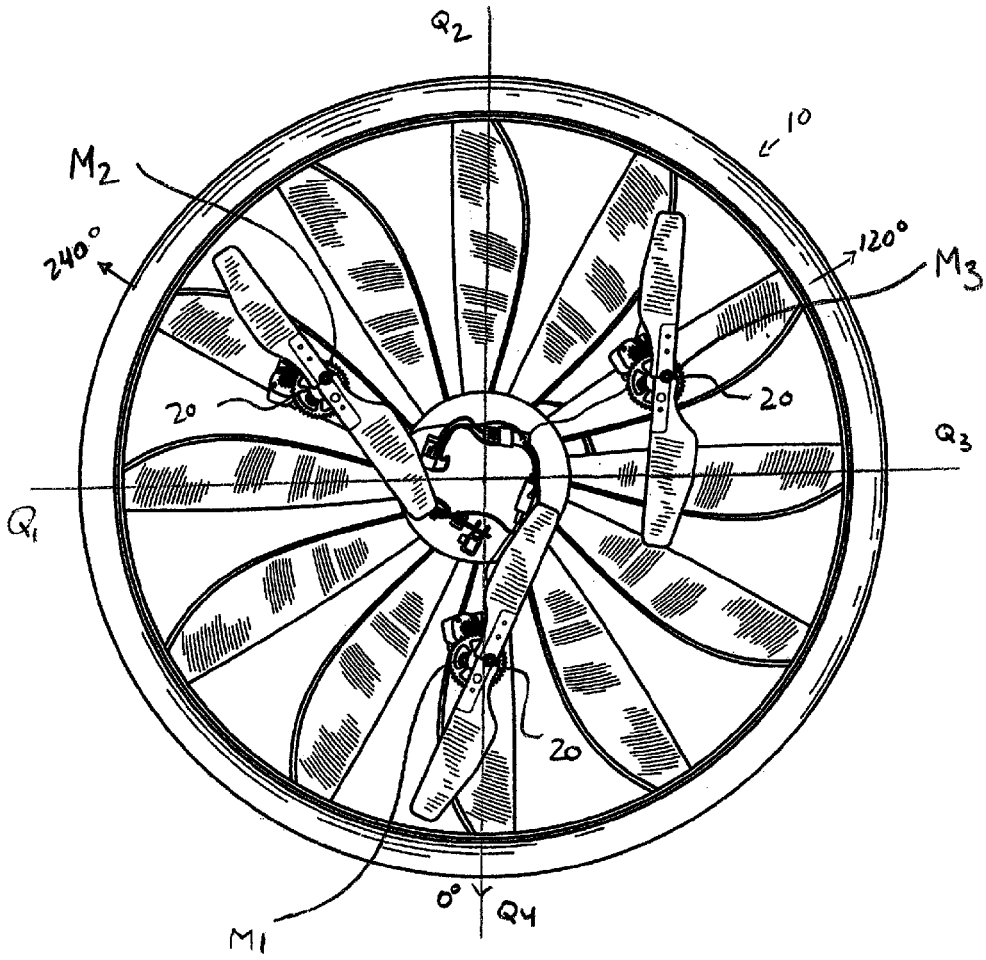
FIG. 7 is an bottom view of the vehicle illustrating the quadrants used for directionally controlling the rotating vehicle.

Referring now to FIG. 7, the rotating vehicle 10 viewed from the bottom may be divided into four quadrants, sequentially labeled Q1, Q2, Q3, and Q4. Viewing the quadrants, Q1 is seen as the bottom/left quadrant, Q2 is the top/left quadrant, Q3 is the top/right quadrant, and Q4 is the bottom/right quadrant. This embodiment also shows three rotor assemblies 20 that are equally spaced, such that each rotor assembly is 120 degrees from one another. The placement of the rotor assemblies is determined by dividing 360 degrees by the number of rotor assemblies thus defining an "offset angle". Each rotor assembly may be further distinguished and referred to as M1, M2, and M3.

It has been determined that by changing the power output to each rotor assembly as they move through the quadrants, the rotating vehicle 10 can be directionally controlled. The moment a position reference is determined, both the rotational position of the rotating vehicle 10 and orientation of the rotor assemblies 20 are known. Moreover, by synchronizing and adjusting the power distributed to the rotor assemblies 20 the rotating vehicle will fly or move in any desired direction from the perspective of the user operating the hand held controller. Thus allowing a user operating the rotating vehicle 10 to align themselves with the vehicle 10 and direct it to the left/right, forwards (or towards the user)/backwards (or away from the user), and up/down, without having the user to move about the rotating vehicle to direct it only in a forwards or backwards position. Since the rotating vehicle 10 is constantly spinning at approximately 300 rpm, the position reference element (either a receiver or transmitter depending upon the control system) can calculate the orientation of the rotating vehicle every ⅕ of a second, permitting a substantially constant determination of such orientation.

In addition, the ability to provide a smoother control of the power distributed to the rotor assemblies 20 can be provided herein. While in vehicle electro mechanical commutators may be used to control the power provided to a motor, a control system is provided that generates a sine wave for each rotor assembly that is out of phase with each other by the aforementioned offset angle (120°). Moreover, the sine waves are constructed using a number of samples to create a single cycle of each sine wave, wherein the mechanical commutators use segments in a commutator ring to control the power; where each segment would correspond to a sample. The sine waves are further constructed from approximately 32 samples, of which it would be extremely difficult to manufacture a commutator with 32 segments. As such the control system allows for a smoother cyclic control of the rotating vehicle.

During operation, a user controlling the rotating vehicle 10 may control a throttle and a directional control. Initially when the vehicle 10 is resting on the ground, the user will control the throttle such that the microprocessor 28 begins to provide and increase the level of a drive signal to each motor 32. The throttle signals to the microprocessor 28 to control the level of the drive signals to each rotor assembly 20 equally such that the rotating vehicle 10 raises and lowers at a level angle and not tilted to one side. If the throttle is increased the microprocessor 28 will increase the level of the drive signal causing the propellers 50 to rotate at a faster rate raising the rotating vehicle 10. Alternately, when the throttle is decreased the level of the drive signals is decreased causing the rotation of the propellers to decrease thereby lowering the rotating vehicle 10.

In another embodiment, the user can control the throttle by moving a throttle controller slightly forward causing the level of the drive signal to increase, and when the throttle is moved forwards "all the way" the level of the drive signal is increased greater than previously causing the rotating vehicle to climb faster. Thus, when the throttle is moved the level of the drive signal is increased or decreased at a proportional rate. This aspect is the same for moving the rotating vehicle in any direction.

When the user desires to move the rotating vehicle 10 in a specific direction, the user may move the directional control. The microprocessor receiving a signal from the directional control will generate sine waves for each rotor assembly M1, M2, and M3. The sine waves will be added to the drive signals causing the motors to increase and decrease the power in accordance to the positive and negative peaks of the sine waves. It is important to note that the sine waves are also out of phase with one another as determined by the offset angle. By shifting the beginning phase angle of each sine wave, the motors can be controlled to move the vehicle in a specified direction. As such, in each instance, the microprocessor shifts the three individual sine waves to the correct beginning phase angle. In addition, the sine waves may have amplitudes to control the speed in which directional movement are made (similar to throttle changes). If the directional controller is moved in one direction slightly, the amplitude of the sine waves may be smaller then when the directional controller is moved all the way in one direction. By adjusting the amplitude and the beginning phase angle of the sine waves, the user can adjust the rate in which the rotating vehicle 10 moves in a particular direction. Lastly, the microprocessor will add (if necessary) the correct level to the drive signals of each motor. Thus the drive signals not only control the direction of the vehicle but also the speed in which the directional movements are made.

Figure 8B:
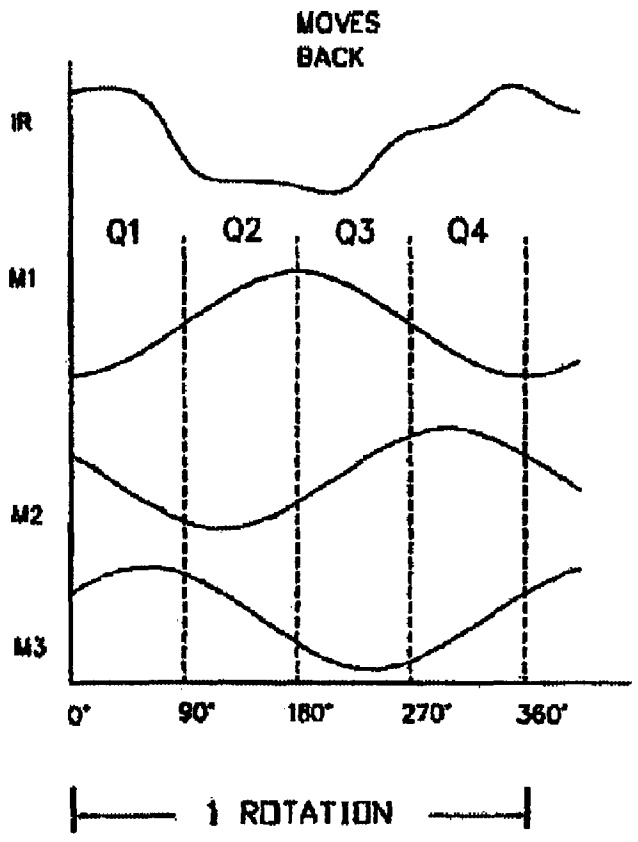
FIGS. 8*a*-8*d* illustrate the sinusoidal waves generated by a microprocessor in order to directionally control the rotating vehicle.
Figure 8A:
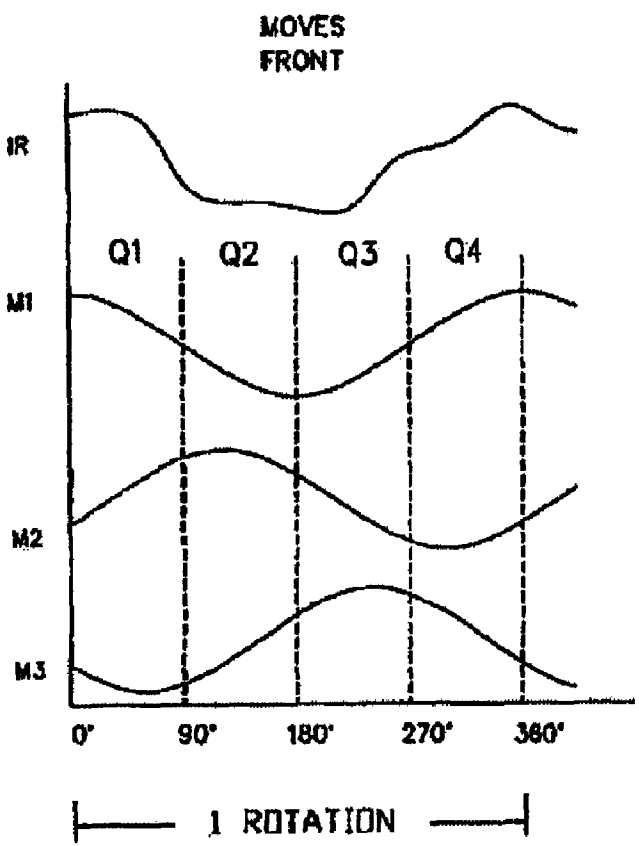
Figure 8D:
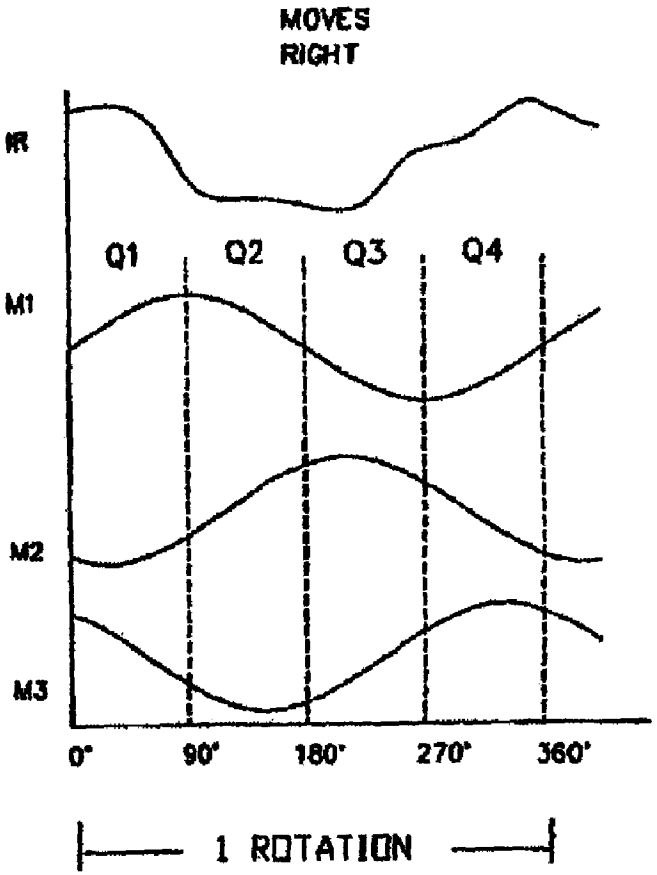
Figure 8C:
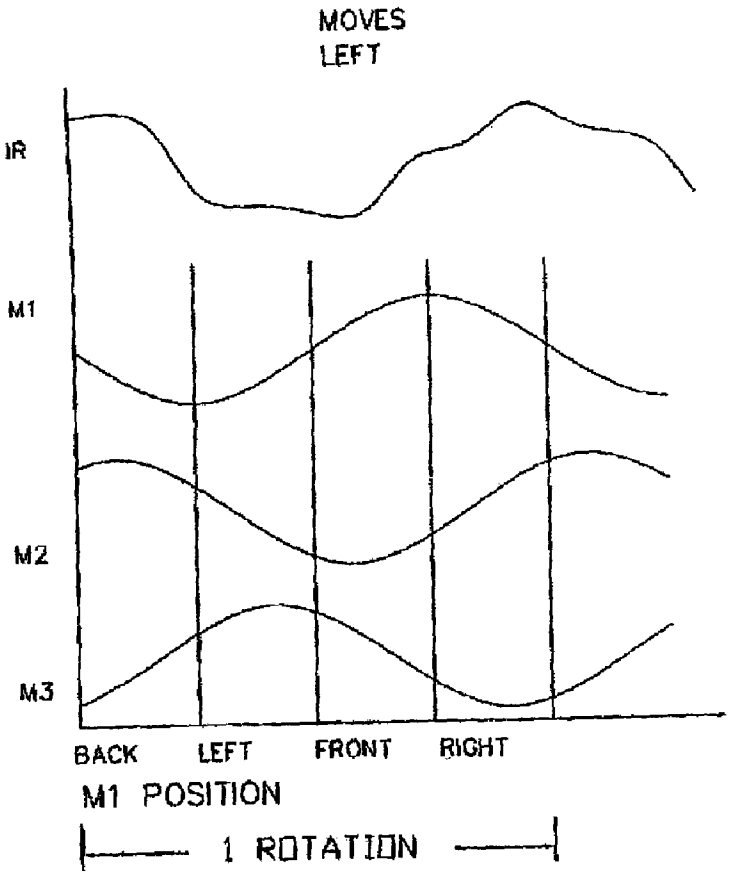

In reference to the directional control inputs to the rotating vehicle 10, FIGS. 8*a* through 8*d* illustrate the sine waves generated by the microprocessor for each rotor assembly M1, M2, and M3 for a single 360° rotation of the vehicle 10. Referring to FIG. 8*a*, at 0° (when the position reference element is aligned with the hand held controller) M1 will have a sine wave for a single cycle (360°) that has a maximum peak value at 0° and a minimum peak value at 180°; M2 being 120° out of phase with M1 will not reach a maximum peak value until it travels 120°; and M3 being 120° out of phase with M2 will not reach a maximum peak value until it travels 240°. The three sine waves added to the drive signal will be such that the propellers 50 will rotate faster in Q1 and Q4 than in Q2 and Q3, thereby moving the rotating vehicle forwards. Referring to FIGS. 8*b* through 8*d*, the relative sine waves for M1, M2, and M3 and how the waves are synchronized with one another based upon the direction of the directional control is illustrated. In FIG. 8*b*, when the propellers rotate faster in Q2 and Q3 than in Q1 and Q4, the rotating vehicle moves backwards towards the user. In FIG. 8*c*, when the propellers rotate faster in Q3 and Q4 than in Q1 and Q2, the rotating vehicle moves to the left. And in FIG. 8*d*, when the propellers rotate faster in Q1 and Q2 than in Q3 and Q4, the rotating vehicle moves to the right.

Figure 9A:
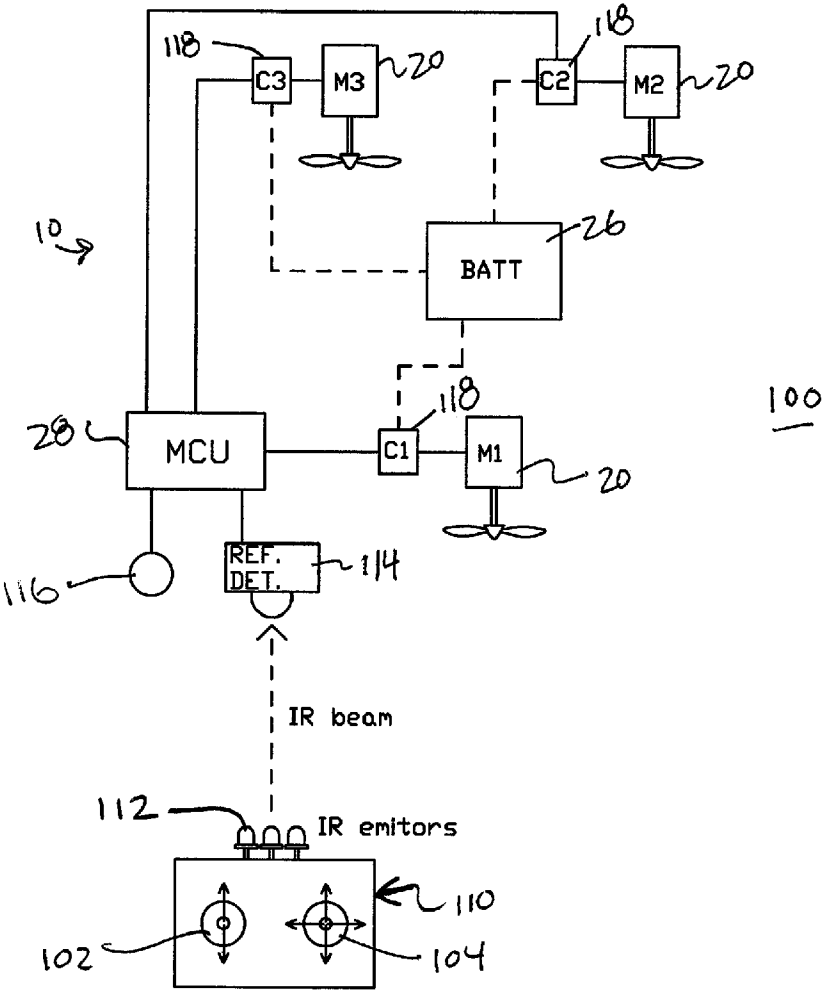
FIG. 9*a* is a first control system used to directionally control the rotating vehicle.

In a first control system embodiment 100, FIG. 9*a*, a hand held controller 110 transmits a non directional IR signal through IR emitters 112. The non directional IR signal is also encoded with the control inputs from the operator. The position reference of the rotating vehicle is determined by a directional IR receiver 114 on the vehicle 10. When the directional IR receiver 114 receives the signal from the hand held controller 110, the microprocessor 28 on the rotating vehicle determines that the rotor assembly M1 is positioned at zero degrees. A non directional IR receiver 116 on the rotating vehicle 10 is used to receive and decode the control input commands from the hand held controller. As mentioned above, the control input commands include throttle and directional control commands, received through a throttle control stick 102 and a directional control stick 104. Motor control calculations are performed by the microprocessor 28 on the rotating vehicle 10.

The microprocessor has programming that creates drive signals in direct response to the encoded signals. The drive signals are sent to the appropriate rotor assemblies M1, M2, and M3 through motor controllers 118 (separately referenced as C1, C2, and C3, respectively). The motor controllers may be part of the rotor assemblies. As described above, the drive signals control the speed of the propellers as the propellers rotate around the quadrants (illustrated in FIG. 7). The drive signals cause the propellers to fly the rotating vehicle in a direction specified by the person operating the hand held controller. Moreover, because the drive signals are sent in relation to the directional point of reference, the rotating vehicle flies in the specified direction as it relates to the remote user. The drive signals may also include level adjustments in response to encoded signals from the throttle controller.

Both the throttle controller and directional controller are manually operable by the user. In addition, both when manipulated by the user causes the IR transmitter to send encoded commands specifically relating to the manipulation thereof. This is typically done through a separate microprocessor and programming positioned in the hand held controller. IR encoding is well known and is typically achieved through a beam encoder.

Figure 9B:
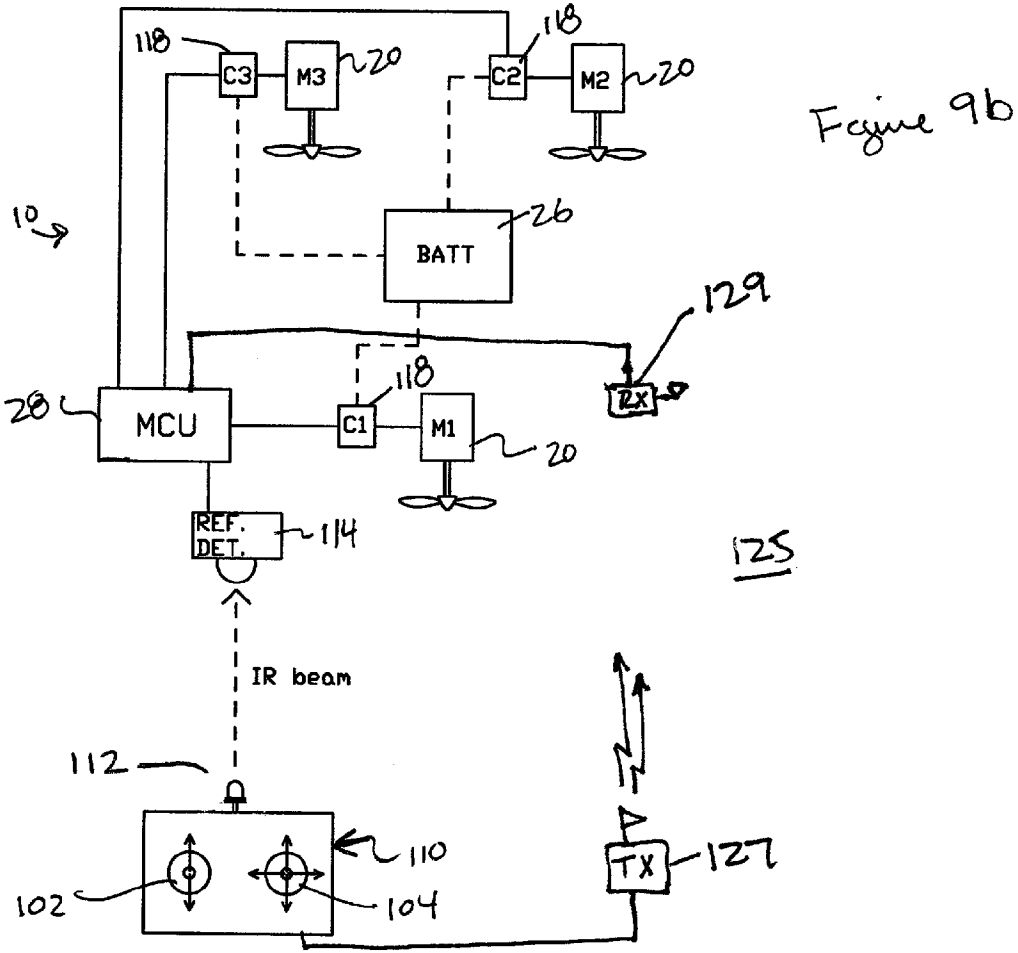
FIG. 9*b* is an alternative control system used to directionally control the rotating vehicle.

In an alternative control system 125, FIG. 9*b*, the position reference is determined by emitting an IR beam from an emitter 112 to a directional receiver 114 on the rotating vehicle. The throttle controller commands and directional controller commands are sent from the hand held controller 110 through a radio transmitter 127 to a radio receiver 129 on the rotating vehicle 10. The commands are sent to the MCU 28 for processing and generating appropriate drive signals.

Figure 9C:
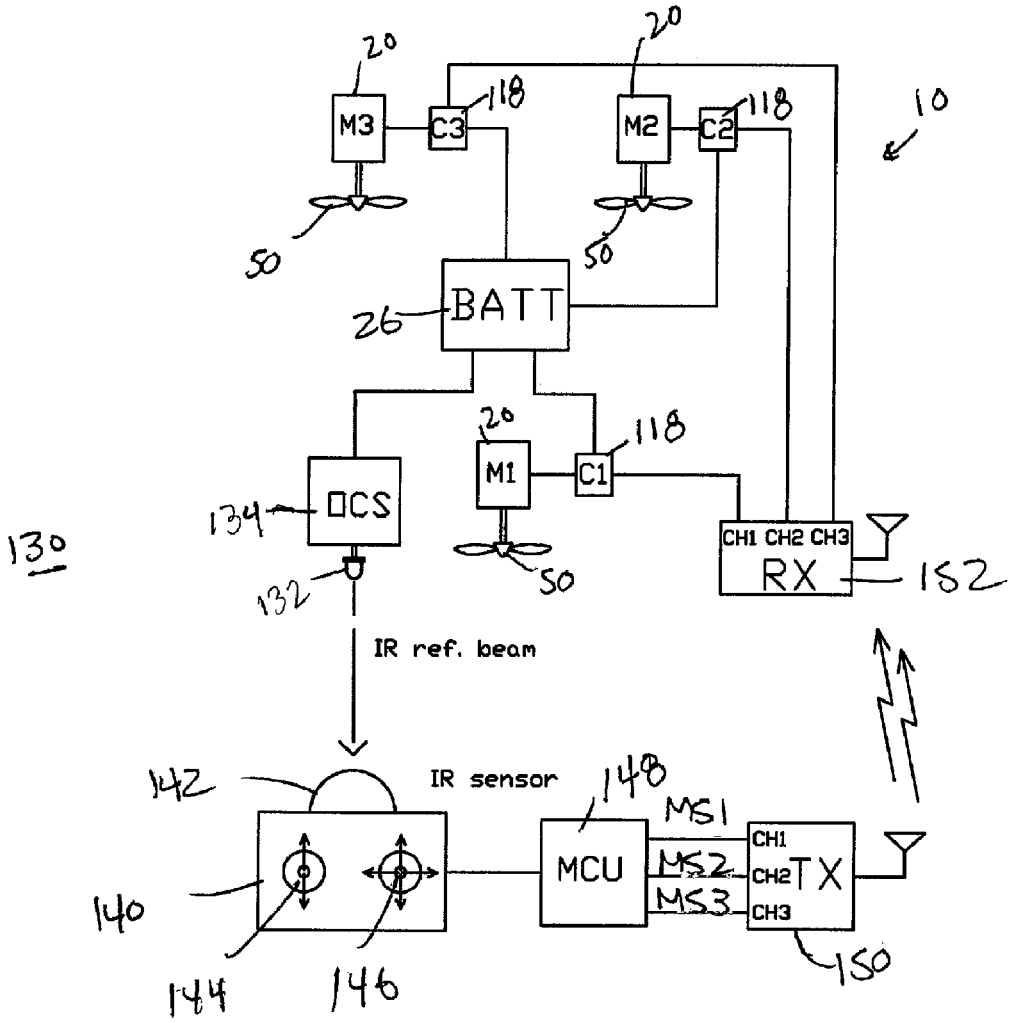
FIG. 9*c* is a second control system used to directionally control the rotating vehicle.

In a second control system 130, FIG. 9*c*, the position reference is determined by emitting a directional IR beam from an emitter 132 controlled by an optical control system 134 on the rotating vehicle 10. A non directional IR receiver 142 on the hand held controller 140 detects the directional IR beam. The received signal and the control inputs from the throttle and directional control commands, received from a throttle control stick 144 and a directional control stick 146, are sent to a microprocessor 148 in the hand held controller 140. The microprocessor 148 translates the signal and control inputs into appropriate motor control signals (as described above in FIGS. 8*a*-8*d*). The motor control signals MS1-MS3 (correlating to the three rotor assemblies M1-M3) are transmitted from the hand held controller 140 by a radio transmitter 150 modulated by the individual motor control signals MS1-MS3 as CH1-CH3 respectively. A radio receiver 152 on the vehicle 10 demodulates the separate motor control signals CH1-CH3 and sends the signals to the motor controllers C1-C3 to appropriately drive the individual motors M1-M3.

Figure 10B:
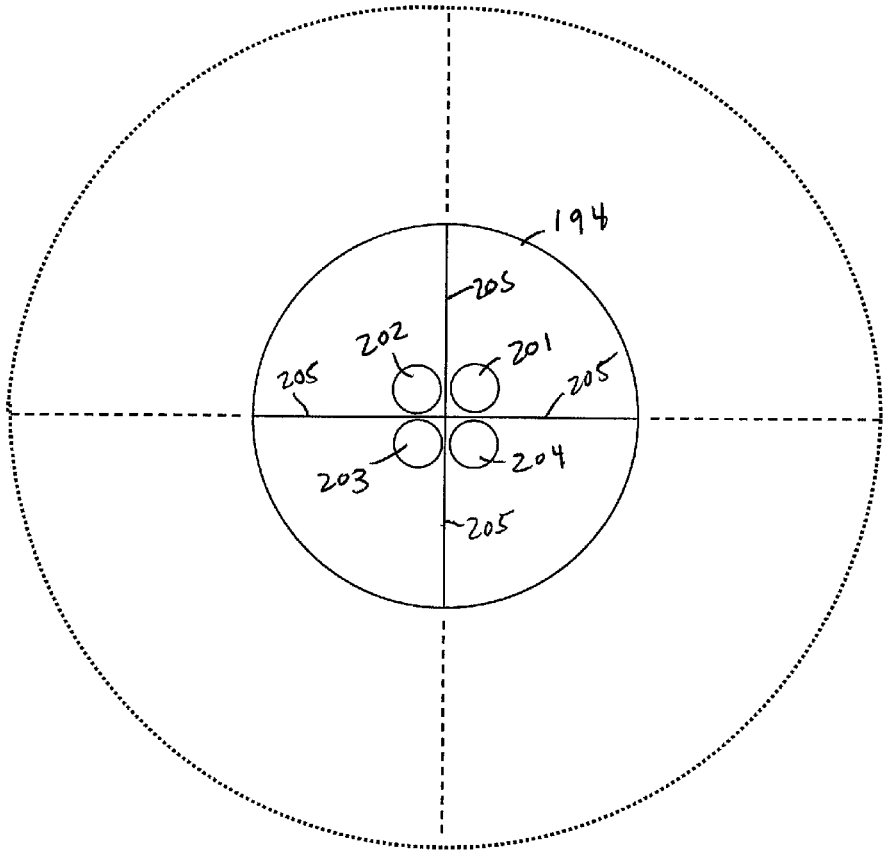
FIG. 10*b* is front view of a dome on a hand held controller, having four IR emitters, the direction emitting beams are also graphically illustrated.

In a third control system 180, FIG. 10*a*, the position reference is done by a directional IR sensor as described above in the control system referenced in FIG. 9*a*. The hand held controller 190 is in the form of a gun with a trigger 192 and a dome 194 positioned in the front of the gun. The hand held controller 190 includes four IR emitters, referred to as 201, 202, 203, 204. As shown in FIG. 10*b*, emitter 201 is the upper left hand corner, emitter 202 is the upper right hand corner, emitter 203 is the lower right hand corner, and emitter 204 is the lower left hand corner. The IR emitters are positioned towards the center of the dome in a circular quadrant placement. In addition, a black wall or reception blocking element 205 may be placed separating the emitters such that the beams or signals do not cross over into other quadrants. The emitters radiate the IR beams outwardly from the center position of the dome 194. A beam encoder 196 in the hand held controller 190 is used to encode the four IR beams with a unique beam. All four beams are encoded with the trigger position (levels of drive signals) which is used by the operator to control the height of the rotating vehicle. To control and move the rotating vehicle 10, the user simply points and moves the hand held controller 190. For example, to move the rotating vehicle 10 towards the user, the hand held controller 190 may be pointed above the rotating vehicle. This exposes the IR receiver 114 on the rotating vehicle to beams 203 and 204. The microprocessor 28 identifying beams 203 or 204 will power the rotor assemblies to move the rotating vehicle forwards. To move the rotating vehicle backwards or away from the user, the hand held controller 190 may be pointed below the rotating vehicle, exposing the IR receiver 114 to beams 201 and 202. To move the rotating vehicle towards the right or left, the hand held controller is moved to the right or left of the rotating vehicle, which exposes the IR receiver to beams 201 and 204, or 202 and 203, respectively.

In an alternative control system to the system described with reference to FIGS. 10*a* and 10*b*, the identification of IR beams 201 through 204 can be used to command and control the height of the rotating vehicle. In this instance, pointing the hand held controller 190 above the rotating vehicle would command the rotating vehicle to climb until it is level with the center of the four beams. The trigger 192 would be used only to engage the hand held controller (similar to an on/off switch). In this control system as the user points the hand held controller up/down/left/right, the rotating vehicle would follow. While the rotating vehicle in this instance cannot move forward and back the user can reposition themselves to the side of the rotating vehicle to command the other directions.

Figure 10C:
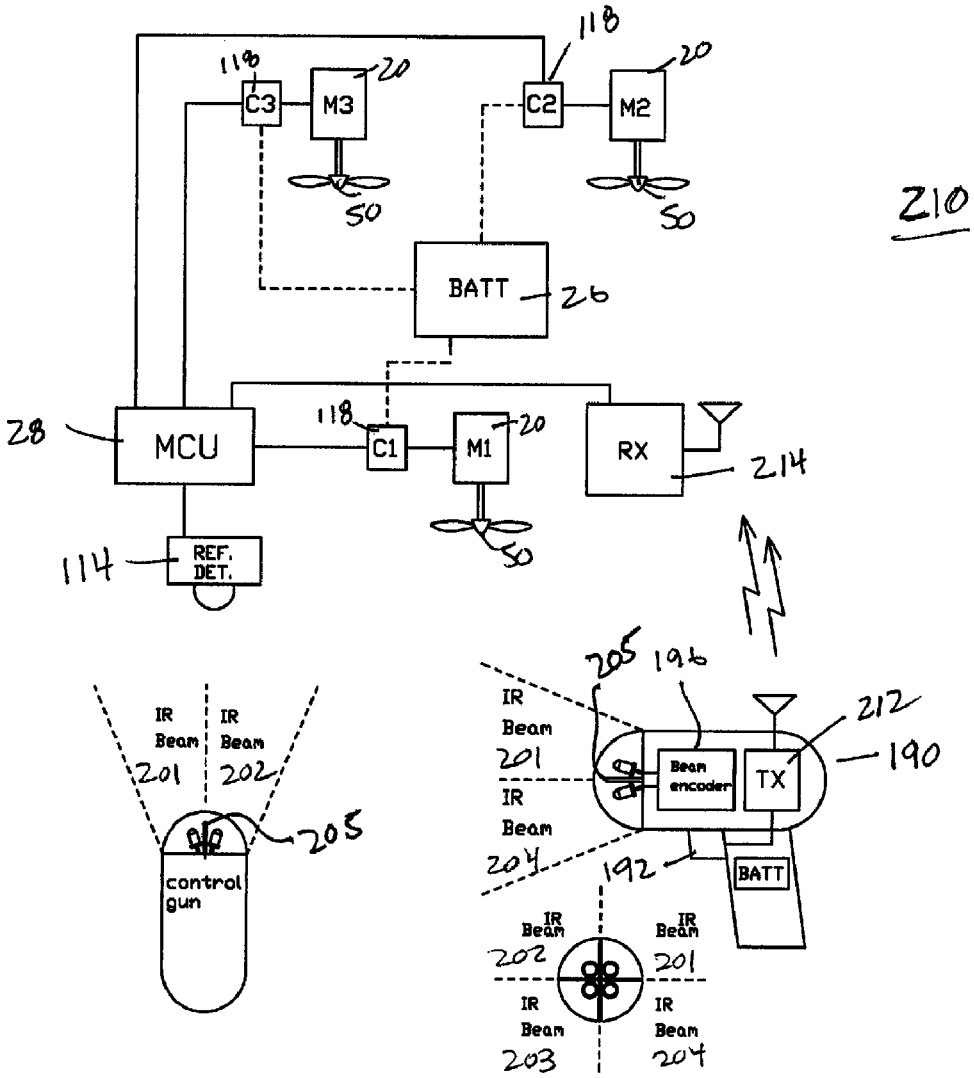
FIG. 10*c* is a fourth control system used to directionally control the rotating vehicle.

In a fourth control system 210, FIG. 10*c*, the system operates identically to the third control system 180 except the trigger information is transmitted by a radio transmitter 212 via a modulated radio signal to a radio receiver 214 on the rotating vehicle 10. This eliminates the need for a second IR receiver on the rotating vehicle and simplifies the beam encoding scheme.

Similar to the control systems in FIGS. 10*a* through 10*c*, it is alternatively contemplated that the IR beams 201 through 204 control the up/down and left/right movement of the rotating vehicle and the trigger 192 (or a toggle—not shown) is used to control the forward and backward movement of the rotating vehicle.

Figure 10D:
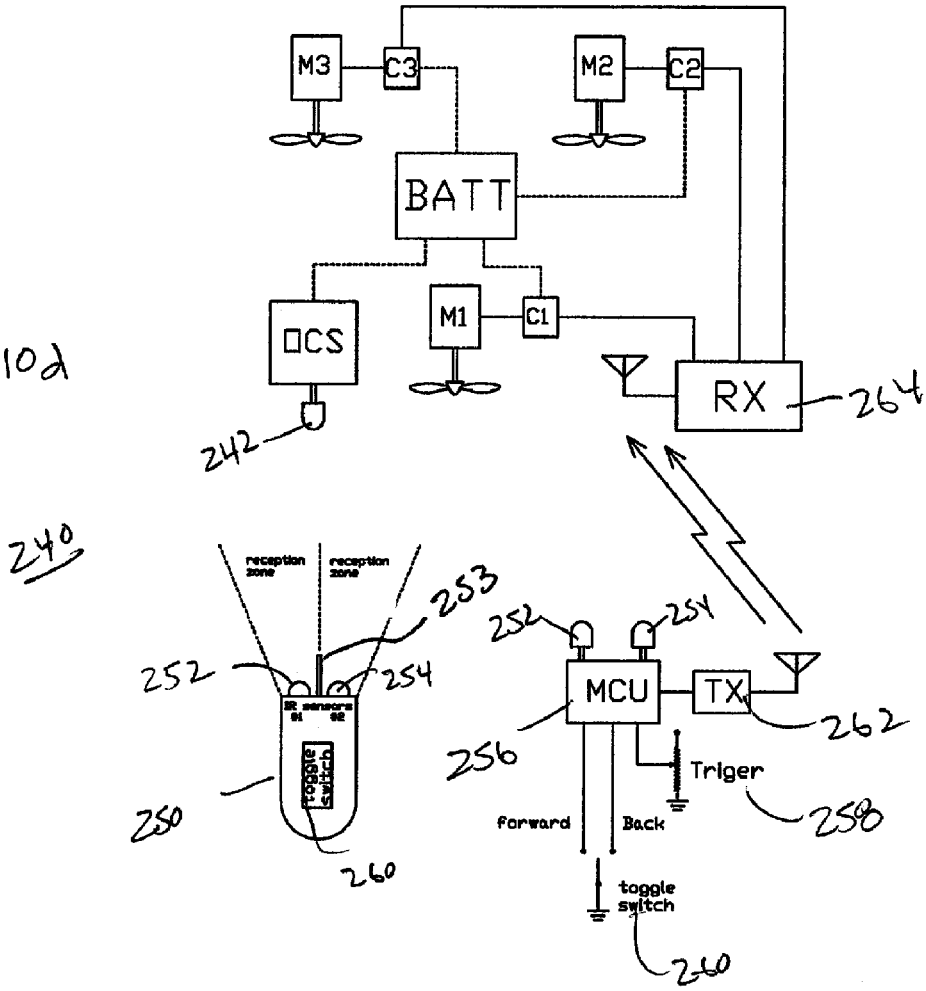
FIG. 10*d* is a fifth control system used to directionally control the rotating vehicle.

In a fifth control system 240, FIG. 10*d*, the rotating vehicle 10 includes an IR emitter 242. The hand held controller 250 includes two separate reference sensors 252 and 254. The first sensor 252 is to the right of the centerline and the second sensor 254 is to the left of the centerline. The centerline is either a black wall or other type of signal blocking partition 253, separating the reception zones of each sensor. The partition 253 helps to prevent the sensors from receiving signals from the other zones or quadrants. The microprocessor 256 on the hand held controller 250 determines where the vehicle 10 is positioned in relation to the hand held controller 250 and commands the rotating vehicle 10 to the right and left with reference to the movement of the hand held controller 250. A trigger 258 is used to command the height of the rotating vehicle as described above. Alternatively, four sensors could be used to facilitate height command and control as well as right and left control.

Continuing to refer to FIG. 10*d*, there is an additional toggle switch 260 on the hand held controller 250 that is used to command the vehicle 10 forward and back. All of the control calculations are done by the microprocessor 256 in the hand held controller 250. Each motor signal is transmitted by a radio transmitter 262 to a radio receiver 264 on the rotating vehicle 10. Each motor is then controlled by a separate channel from a radio receiver.

It is further contemplated that the control systems described above can be employed to control the flight path of a flying aircraft having at least one propeller mechanism. The propeller mechanism would include a propeller, a motor, and a means to control the propeller. The control means may be a means to change the pitch of the propeller while rotating or similar to the above a means to control the drive signals being sent to the motor. The control system would work in connection with a hand held controller operable by a user. In the hand held controller, similar to above, four transmitters would be positioned in a domed front portion therein, in a circular quadrant placement. Each transmitter would send a signal that is identifiable from the other signals. The aircraft further has a receiver, and a microprocessor in communication with the receiver. The microprocessor has means to communicate with the control means to move the aircraft in a specified direction in response to received signals. For example, when the receiver is receiving two of the four signals, caused by the hand held controller being moved in a direction, the microprocessor controls the propeller mechanism to fly the aircraft in a specified direction that corresponds to the movement of the hand held controller.

The control system may also be employed to move ground vehicles that track and follow the movement of the hand held controller.

It should be further stated the specific information shown in the drawings but not specifically mentioned above may be ascertained and read into the specification by virtue of a simple study of the drawings. Moreover, the invention is also not necessarily limited by the drawings or the specification as structural and functional equivalents may be contemplated and incorporated into the invention without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

I claim:

1. A rotating flying vehicle comprising:

a hub having an outer perimeter;

an outer ring having a diameter greater than said outer perimeter defined by the hub;

a plurality of blades extending outwardly and downwardly connecting the hub to the outer ring;

a plurality of rotor assemblies, each rotor assembly includes a motor to spin a propeller, said propeller being positioned beneath said plurality of blades, a mechanism controlling all of the propellers to spin in the same direction such that when spinning the propellers cause the hub, blades, and outer ring to sufficiently rotate in an opposite direction as the spinning propellers and will generate lift such that the vehicle will fly;

a system for determining a directional point of reference for the rotor assemblies as the entire vehicle is rotating; and a control system to fly the vehicle in a specified direction based on the directional point of reference and relative to a remote user.

2. The vehicle of claim 1, wherein the plurality of rotor assemblies are separately secured to a bottom surface of a blade, of the plurality of blades, and positioned above a bottom section of the outer ring to improve stabilization of the vehicle when rotating and flying.

3. The vehicle of claim 1, wherein the system for determining said directional point of reference comprises:

a transmitter being placed on a hand held controller operated by a remote user, the transmitter emitting a signal; and a directional receiver placed at a position on the vehicle in relation to the rotor assemblies, the directional receiver being in communication with a microprocessor, the microprocessor having programming to determine the directional point of reference of the rotor assemblies when the directional receiver senses said signal.

4. The vehicle of claim 3, wherein the control system comprises:

a non directional receiver positioned on the vehicle and in communication with the microprocessor;

the transmitter further emitting encoded commands to fly the vehicle in a specified direction relative to the remote user, the encoded commands being received by said non directional receiver; and the microprocessor having programming to control the rotor assemblies in response to received encoded commands and in relation to the directional point of reference such that the vehicle flies in said specified direction relative to the remote user.

5. The vehicle of claim 4, wherein the microprocessor includes programming to generate a drive signal for each rotor assembly and corresponding to said encoded commands wherein the drive signals control the vehicle such that the vehicle will move in said specified direction.

6. The vehicle of claim 5, wherein the hand held controller further includes:

a throttle controller manually operable by said remote user, the throttle controller when manipulated by said remote user causes the transmitter to send encoded commands to indicate to the microprocessor to increase and decrease a level of each drive signal.

7. The vehicle of claim 5, wherein the hand held controller further includes:

a directional controller manually operable by said remote user, the directional controller when manipulated by said remote user causes the transmitter to send encoded commands to indicate to the microprocessor to generate said drive signal for each rotor assembly.

8. The vehicle of claim 5, wherein each drive signal includes a sinusoidal wave that is out of phase with one another by a predetermined offset angle defined by the placement of the rotor assemblies in reference to each other.

9. The vehicle of claim 3, wherein the control system comprises:

a radio receiver positioned on the vehicle and in communication with the microprocessor;

a radio transmitter being positioned on the hand held controller further emitting encoded commands to fly the vehicle in a specified direction relative to the remote user, the encoded commands being received by said radio receiver; and the microprocessor having programming to control the rotor assemblies in response to received encoded commands and in relation to the directional point of reference such that the vehicle flies in said specified direction relative to the remote user.

10. The vehicle of claim 9, wherein the microprocessor includes programming to generate a drive signal for each rotor assembly and corresponding to said encoded commands wherein the drive signals control the vehicle such that the vehicle will move in said specified direction.

11. The vehicle of claim 10, wherein the hand held controller further includes:

a throttle controller manually operable by said remote user, the throttle controller when manipulated by said remote user causes the transmitter to send encoded commands to indicate to the microprocessor to increase and decrease a level of each drive signal.

12. The vehicle of claim 10, wherein the hand held controller further includes:

a directional controller manually operable by said remote user, the directional controller when manipulated by said remote user causes the transmitter to send encoded commands to indicate to the microprocessor to generate said drive signal for each rotor assembly.

13. The vehicle of claim 12, wherein each drive signal includes a sinusoidal wave that is out of phase with one another by a predetermined offset angle defined by the placement of the rotor assemblies in reference to each other.

14. The vehicle of claim 1, wherein the system for determining said directional point of reference comprises:

an emitter positioned in the vehicle, the emitter emitting a directional signal; and a receiver positioned in a hand held controller, the hand held controller having a microprocessor such that upon sensing the directional signal, the microprocessor determines the directional point of reference of the rotor assemblies.

15. The vehicle of claim 14, wherein the control system comprises:

the vehicle having a radio receiver, and means to control the rotor assemblies in response to drive signals received by said radio receiver; and the hand held controller having a radio transmitter in communication with the microprocessor, and the microprocessor having programming to generate drive signals that direct the vehicle in a direction in response to inputs from a user, wherein said inputs relate to flying the vehicle in a specified direction relative to the remote user and said drive signals control the vehicle to move in said specified direction, the drive signals being transmitted from said radio transmitter.

16. The vehicle of claim 15, wherein the hand held controller further includes:

a throttle controller manually operable by said remote user, the throttle controller when manipulated by said remote user causes the microprocessor to increase and decrease a level of each drive signal.

17. The vehicle of claim 16, wherein the hand held controller further includes:

a directional controller manually operable by said remote user, the directional controller when manipulated by said remote user causes the microprocessor to generate drive signals which include sinusoidal waves that are out of phase with one another by a predetermined offset angle defined by the placement of the rotor assemblies in reference to each other.

18. The vehicle of claim 1, wherein the control system comprises:

a hand held controller operable by a user, the hand held controller includes four transmitters in a circular quadrant placement, each transmitter sends a signal that is identifiable from the other signals, and a signal blocking element positioned between two adjacent transmitters to reduce intermingling of signals; and the vehicle having a receiver, and a microprocessor in communication with the receiver, the microprocessor having means to generate drive signals in relation to the received signals and to send said drive signals to the rotor assemblies, the drive signals are defined to control the rotor assemblies in a manner that moves the vehicle in a specified direction, wherein when the receiver is receiving two of the four signals, caused by the hand held controller being moved in a direction, the microprocessor generates the drive signals to move the vehicle in a specified direction that corresponds to the movement of the hand held controller.

19. The vehicle of claim 18, further comprising:

a throttle input positioned in the hand held controller and manually operable by said user, means to augment each signal emitted from the hand held controller in response to said throttle input, the microprocessor positioned in the vehicle having programming to control a level of each drive signal in relation to the augmentation of the signals.

20. The vehicle of claim 18, further comprising:

the hand held controller having a radio transmitter, a throttle input positioned in the hand held controller and manually operable by said user, means to generate a radio signal in response to said throttle input and to send said radio signal from the radio transmitter; and a radio receiver positioned in the vehicle in communication with the microprocessor, the microprocessor having programming to control a level of each drive signal in relation to the received radio signal.

21. The vehicle of claim 1, wherein the control system comprises:

the vehicle having a transmitter for sending a signal, and a receiver for receiving drive signals; and a hand held controller operable by a user, the hand held controller includes two adjacent receivers, a signal blocking element positioned between the two adjacent receivers to reduce intermingling of the reception of said signal, a microprocessor in communication with the receivers, the microprocessor having means to generate drive signals in relation to the received signal, a transmitter in communication with said microprocessor to send said drive signals to the vehicle, the drive signals defined to control the rotor assemblies in a manner that moves the vehicle in a specified direction, wherein when the hand held controller is moved in a direction and the reception of the signal by the two adjacent receivers changes, the microprocessor generates the drive signals to move the vehicle in a specified direction that corresponds to the movement of the hand held controller.

22. The vehicle of claim 21, wherein the control system further comprises:

the hand held controller having a throttle input manually operable by said user, the throttle input in communication with the microprocessor which further includes programming to change a level of each drive signal.

23. The vehicle of claim 21, wherein the transmitter is fixed on the vehicle at a predetermined position and the microprocessor includes programming to identify the predetermined position upon receipt of said signal, whereby said directional point of reference on the vehicle is determined upon said receipt of said signal.

24. The vehicle of claim 23, wherein the control system further comprises:

the hand held controller having a switch manually operable by said user, and the switch being in communication with the microprocessor, the switch when operated by said user causes the microprocessor to generate drive signals that control the vehicle towards or away from the user.

25. A rotating vehicle comprising:

a hub;

a plurality of blades extending outwardly and downwardly from the hub, the plurality of blades each having a portion connected to an outer ring;

a plurality of rotor assemblies for rotating the hub and blades sufficiently to generate lift, each rotor assembly has a rotor being positioned underneath the blades; and a mechanism controlling the plurality of rotor assemblies to spin the rotors in the same direction such that when spinning, the rotors cause the hub, blades, and outer ring to sufficiently rotate in an opposite direction as the spinning rotors, and will generate lift such that the vehicle will fly.

26. The rotating vehicle of claim 25 wherein each rotor assembly is separately secured to a bottom surface defined by a blade, of the plurality of blades.

27. The rotating vehicle of claim 25 further comprising:

a means for determining a directional point of reference for the rotor assemblies when the vehicle is rotating; and a means to control and fly the vehicle in a specified direction.

* * * * *